United States Patent [19]

Bye et al.

[11] Patent Number: 4,899,420

[45] Date of Patent: Feb. 13, 1990

[54] HINGE SYSTEM

[75] Inventors: Duane Bye, Devils Lake, Md.; Robert Haugen, N. Fargo, N. Dak.

[73] Assignees: Laurie Stanley Hardie, Surfers Paradise; Leonard John Coleman, Seafarer Court, both of Australia

[21] Appl. No.: 242,353

[22] Filed: Sep. 9, 1988

[51] Int. Cl.[4] ..... E05F 3/02

[52] U.S. Cl. ..... 16/1 C; 16/66; 16/261; 16/270; 16/289; 16/306; 16/344; 16/349; 49/386; 217/60 R; 217/60 B; 217/61; 128/24.1

[58] Field of Search ..... 16/289, 306, 335, 342, 16/84, DIG. 17, 223, 349, 346, 258, 343, 261, 286, 290, 291; 180/69.21; 296/76; 292/338, 339, 263; 49/265, 273, 356, 386, 465; 220/336, 345, 346, 348

[56] References Cited

U.S. PATENT DOCUMENTS

| | | | |
|---|---|---|---|
| 3,131,420 | 5/1964 | Quinn | 16/66 |
| 3,643,291 | 2/1972 | Clark | 16/289 |
| 4,281,733 | 8/1981 | Miller et al. | 180/69.21 |
| 4,623,132 | 11/1986 | Smith | 16/306 |
| 4,712,538 | 12/1987 | Hardie et al. | 4/254 |

*Primary Examiner*—Nicholas P. Godici
*Assistant Examiner*—Edward A. Brown
*Attorney, Agent, or Firm*—Lackenbach Siegel Marzullo & Aronson

[57] ABSTRACT

A hinge system for a large or heavy cover member hinged to a container member. A container hinge plate is secured to a side wall of the container member and a cover hinge plate is secured to the side wall of the cover member and rotatably connected to the first hinge means at a hinge pivot means. A gas strut unitary with and pivotably mounted to the container and cover hinge plates raises and lowers the cover member to open and closed positions relative to the container member. The gas strut is pivotably attached to the container and cover hinge plates. A quick connect-disconnect plate removably connected to the cover hinge plate and rotatably connected to the hinge pivot is used to connect or disconnect the container hinge plate from the cover hinge plate and thus to connect or disconnect the cover member to or from the container member and thus connect or disconnect the container member to or from the cover member. The hinge system including the quick connect-disconnect plate can be mounted to a heavy door.

20 Claims, 5 Drawing Sheets

FIG. 1
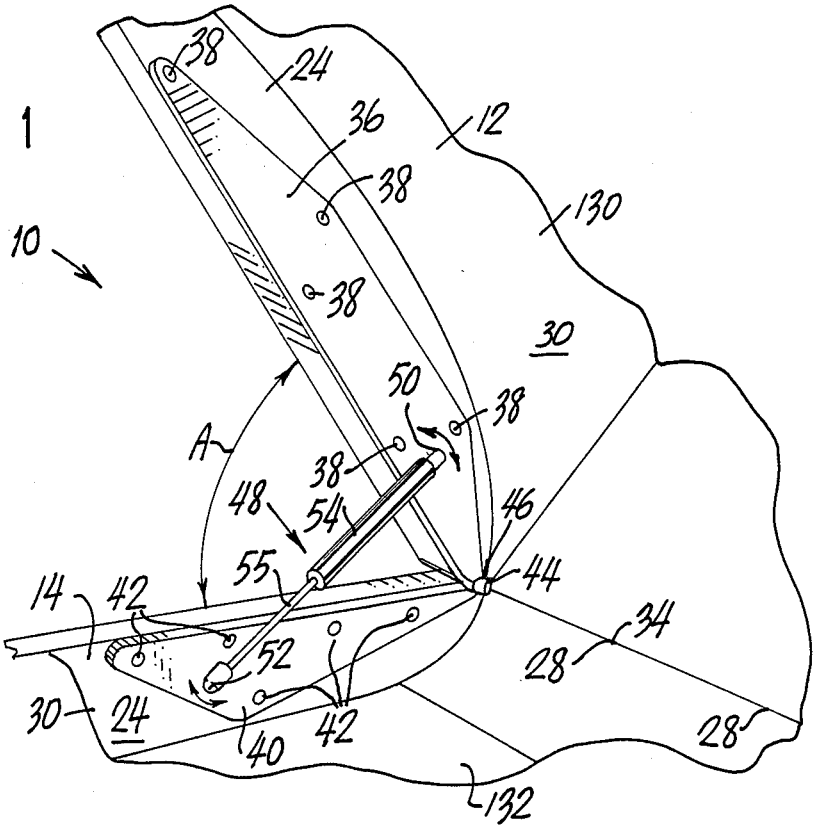
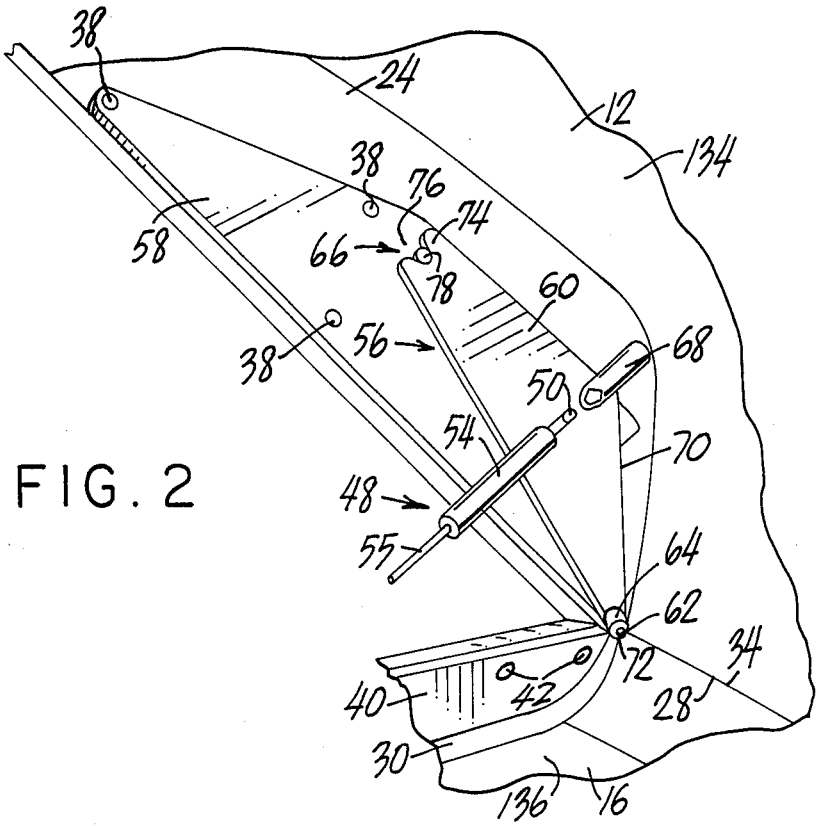
FIG. 2

HINGE SYSTEM

FIELD OF THE INVENTION

This application relates generally to hinges and more particularly to a hinge which is attached to a large or heavy rotatable movable portion and to a stationary portion, the rotatable portion being at least partly powered between open and closed positions. In addition, the invention relates to a hinge release device.

SUMMARY OF THE INVENTION

A large or heavy lid or cover hinged to a hollow container such as a box or a vessel often has to be raised for a time and held in position. Lifting can be difficult especially when one person has to do the task, so that a lifting and lowering mechanism, such as a pneumatically operated strut, is often used.

A particular case is that of a vibratory sauna as described in Hardie et al. U.S. Pat. No. 4,712,538 issued December 15, 1987. The sauna has a large lid that must be raised for a time to an angle that allows a person to climb in and out of the bottom member. The cover is then lowered for the duration of the operation of the sauna until the time comes to raise the cover. Although the cover is made of plastic, its somewhat large size makes aid during raising and lowering helpful. The angle of elevation of the cover should be enough to accommodate the person using the sauna. A wide angle of elevation is needed to accommodate the passage of the body of the user.

Another problem relating to certain lids, including the sauna cover described, is that of easily and quickly disconnecting the lid from the bottom container in preparation for shipping and moving and also of easily and quickly connecting the lid with the container.

The comments made above relative to large or heavy lids hinged to bottom containers can also generally be made relative to large or heavy doors such as large refrigerator doors, large garage doors, and portal doors, as a few examples. In addition, they are applicable in situations where quick connect and disconnect hinges connected to a power mechanism would be required, such as in both the assembly and the operation of space stations.

SUMMARY OF THE INVENTION

Accordingly, it is a principle object of the present invention to provide a hinge system and a lifting and lowering mechanism which is unitary with the hinge system.

It is another object of the present invention to provide a hinge system unitary with a lifting or lowering mechanism that includes a device for quickly separating one of the hinges and the swingable portion to which it is attached from the from the other of the hinges and the other portion to which it is attached so that the two portions can be easily and quickly separated or joined.

It is another object of the present invention to provide an opening or closing mechanism for a large or heavy lid hinged to a bottom container such that the lid can be easily and quickly disconnected from or connected to the bottom container.

It is yet another object of the present invention to provide a hinge system unitary with an opening or closing mechanism for a large lid or door that allows the lid or door to be easily opened or closed and kept propped in its open position at a wide angle.

In accordance with the above objects and others which will become apparent hereinafter, there is provided a hinge system for a large or heavy cover member hinged to a container member. A container hinge plate is secured to a side wall of the container member and a cover hinge plate is secured to the side wall of the cover members and rotatably connected to the first hinge means at a hinge pivot means. A gas strut unitary with and pivotably mounted to the container and cover hinge plates raises and lowers the cover member to open and closed positions relative to the container member. The gas strut is pivotably attached to the container and cover hinge plates. A quick connect-disconnect plate removably connected to the cover hinge plate and rotatably connected to the hinge pivot is used to connect or disconnect the container hinge plate from the cover hinge plate and thus to connect or disconnect the cover member to or from the container member and thus connect or disconnect the container member to or from the cover member. The hinge system including the quick connect-disconnect plate can be mounted to a heavy door.

The present invention will be better understood and the objects and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof. Other embodiments or modifications may be suggested to those having the benefit to the teachings herein, and such other embodiments of modifications are intended to be reserved especially as they fall within the scope and spirit of the subjoined claims.

BRIEF DESCRIPTION OF THE DRAWINGS

FIG. 1 is a detail perspective view of a single hinge according to the present invention;

FIG. 2 is a fragmented perspective view of another embodiment of the invention similar to the view shown in FIG. 1 with a connect-disconnect plate with a locking lever connected to an upper hinge plate;

DETAILED DESCRIPTION OF THE PREFERRED EMBODIMENTS

Figure 3:
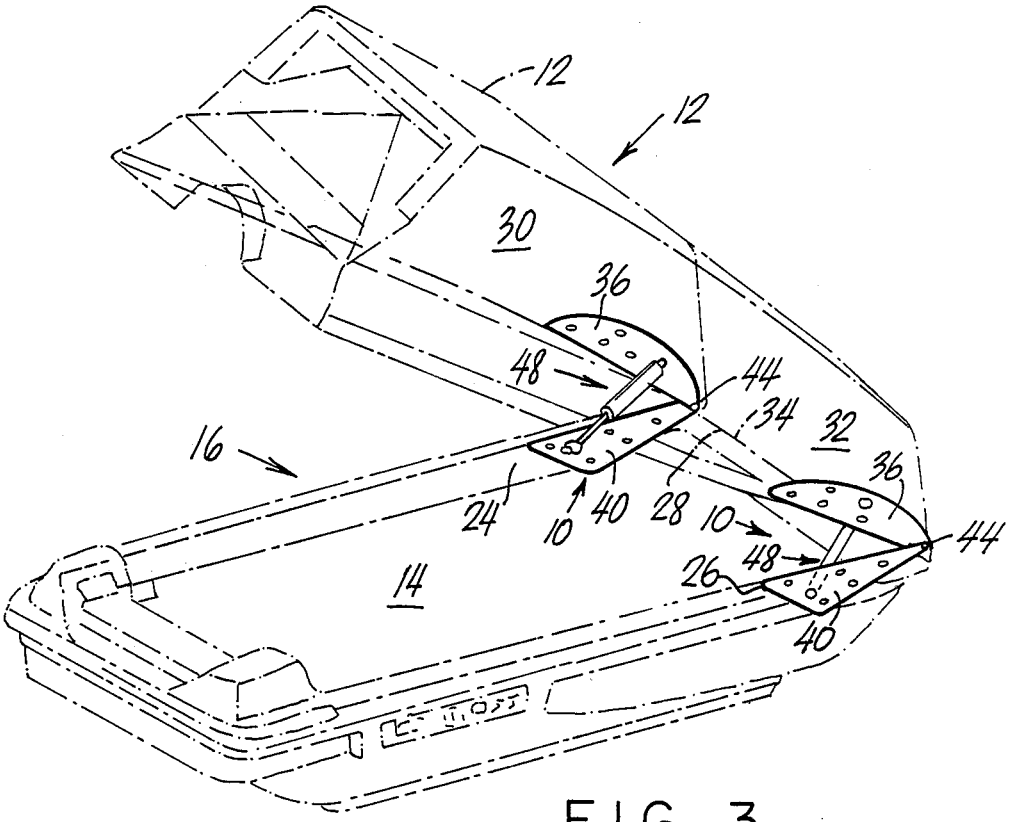
FIG. 3 is a perspective view of a pair of hinges according to the present invention connecting a cover member to the bottom housing of a vibratory sauna

Reference is now made specifically to the drawings in which identical or similar parts are designated by the same reference numerals throughout.

A hinge system 10 for a movable cover member 12 for an opening 14 defined by a stationary structure 16 is illustrated in FIG. 1. FIG. 3 illustrates a pair of hinge systems 10 mounted on a vibratory sauna 18 (shown in phantom line) such as the one described in Hardie et al. U.S. Pat. No. 4,712,538 issued Dec. 15, 1987 with movable cover member 12 being the upper closure member, or cover 12, and stationary structure 16 being the lower housing 16. Lower housing 16 has vertical side walls 24 an 26 and a horizontal linear edge 28 generally perpendicular to side walls 24 and 26. Cover member 12 has vertical side walls 30 and 32 generally parallel to and aligned with side walls 24 and 26, respectively, and a horizontal linear edge 34 aligned with linear edge 28. Cover member 12 is rotatable relative to lower housing 16 along linear edge 34 and is shown in the open position in FIG. 3 as is generic cover member 12 in FIG. 1.

Each hinge system 10 includes an upper hinge plate 36 secured by rivets 38 to the inner surfaces of vertical side walls 30 and 32; and a lower hinge plate 40 secured by rivets 42 to the inner surfaces of vertical side walls 24 and 26.

A pair of horizontal hinge pivots 44 are positioned in a bushing 46 connected to upper and lower hinge plates 38 and 40 positioned adjacent to linear edges 28, 34. Each hinge pivot 44 rotatably connects cover member 12 with lower housing 16. Cover member 12 is rotatably movable about hinge pivots 44 along linear edge 34 between closed and open positions. The closed position is when cover member 12 closes opening 14 and the open position is when cover member 12 is rotated away from lower housing 16 to a preselected position. The preselected position of cover member 12 can be generally designated in angular degrees A between the horizontal plane of opening 14 defined at the top side of lower housing 16 and the horizontal plane of the bottom side plane of cover member 12 in particular where both the horizontal and bottom side planes are coextensive with linear edges 34 and 28, respectively.

An elongated pneumatic, or air pressurized, strut 48 having opposed first and second ends 50 and 52 pivotably mounted to upper and lower hinge plates 36 and 40, respectively, for pressuring cover member 12 to its open position upon external initiation of movement of cover member 12 by manual raising by a user towards its predetermined open position, for maintaining cover member 12 at its predetermined open position, for pressuring cover member 12 towards its closed position upon external initiation of movement of cover member 12 by manual operation by the user towards its closed position, and for maintaining the cover member 12 at its closed position. Pneumatic strut 48 includes a pneumatic cylinder 54 and an arm member 55 slidably mounted with pneumatic cylinder 54. Pneumatic cylinder 54 is rotatably connected to upper hinge plate 36 at end 50, and arm member 55 is rotatably connected to lower hinge plate 40 at end 52.

Figure 4:
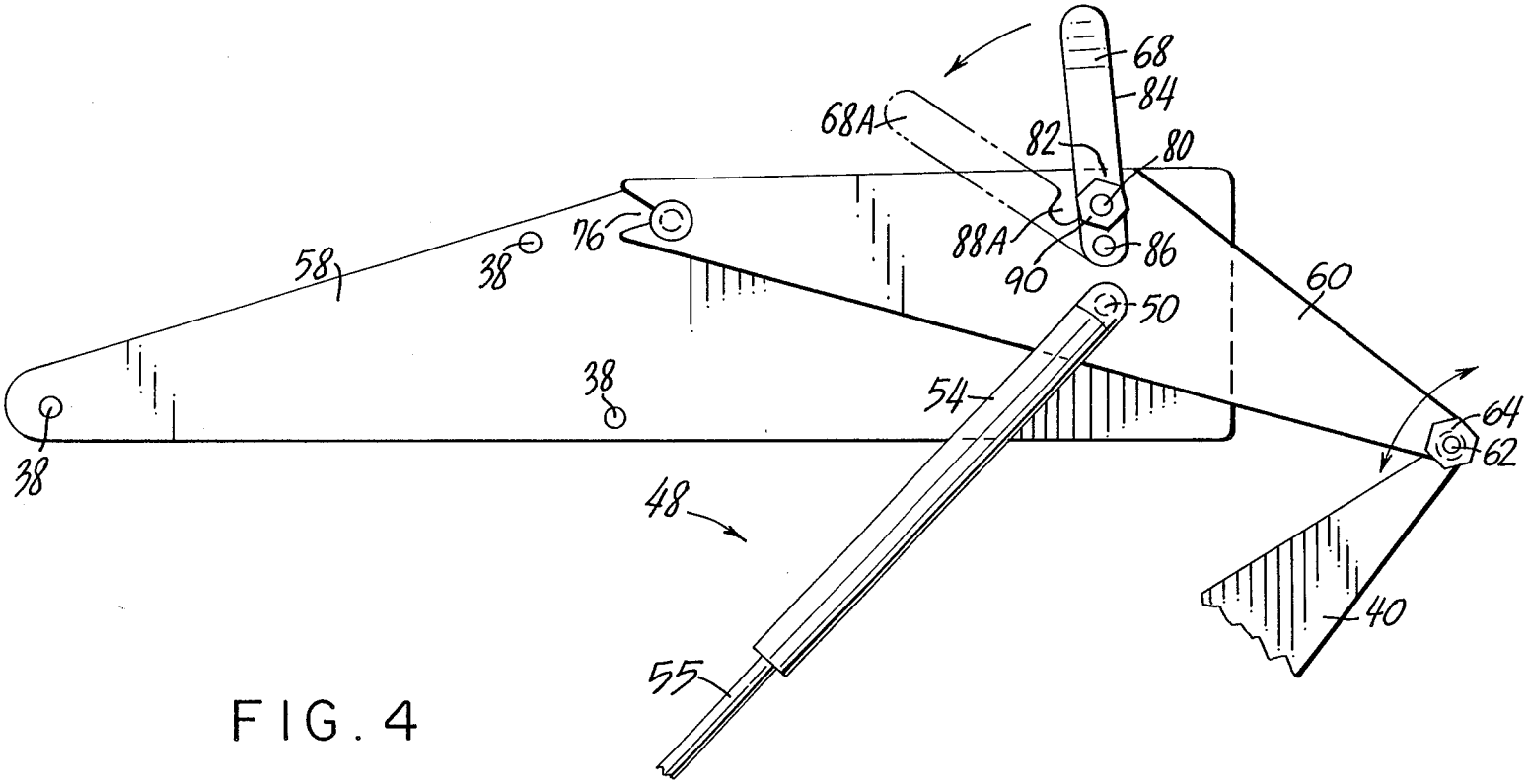
FIG. 4 is an isolated elevational view of the cover member hinge plate and the connector plate with fragments of the bottom housing hinge plate and the gas strut of the hinge system with the quick connect-disconnect system in its locked mode.
Figure 5:
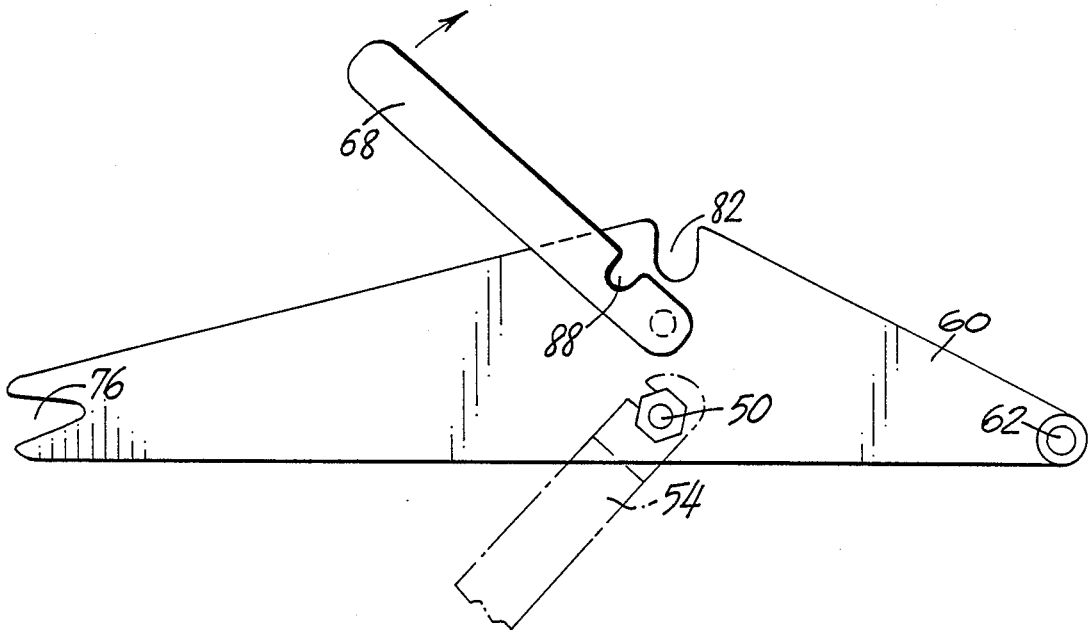
FIG. 5 is an isolated elevational view of the connector plate with the locking lever illustrated in its open mode.
Figure 6:
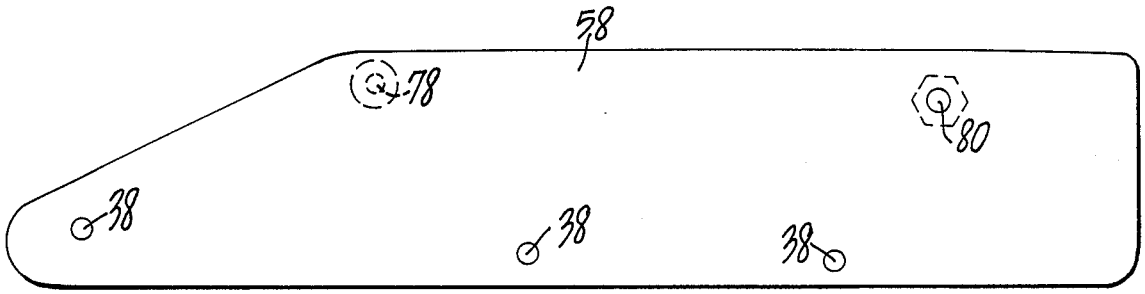
FIG. 6 is an isolated elevational view of the a cover member hinge plate.

FIG. 2 illustrates a quick connect-disconnect system 56 which includes an upper hinge plate 58, illustrated in isolation in FIG. 6, secured to upper side wall 24 by rivets 38 and a quick connect-disconnect plate 60 removably connected to hinge plate 58. FIG. 4 illustrates in isolation quick connect-disconnect plate 60 connected to upper hinge plate 58 and rotatably connected to a horizontally aligned pivot 62 mounted in a bushing 64 which is connected both to lower hinge plate 40 and to connect-disconnect plate 60. Connect-disconnect plate 60 is for quickly connecting and disconnecting upper hinge plate 58 from lower hinge plate 40 and thus connecting or disconnecting cover member 12 from lower housing 16. In the same manner, connect-disconnect plate 60 is also for quickly connecting upper hinge plate 58 to lower hinge plate 40 and thus connecting cover member 12 to stationary structure 16, or, sauna cover member 12 to lower housing 16. Quick connect-disconnect plate 40 is shown in an isolated view in FIG. 5.

Quick connect-disconnect plate 60 is positioned adjacent and lateral to upper hinge plate 58 and includes a positioning mount 66 associated with upper hinge plate 58 and connect-disconnect plate 60 for removably mounting connect-disconnect plate 60 with upper hinge plate 58 and further includes a latch 68 associated with upper hinge plate 58 and connect-disconnect plate 60 for removably locking connect-disconnect plate 60 to upper hinge plate 58.

Connect-disconnect plate 60 includes an edge portion 70 and is generally elongated having opposed ends 72 and 74 with end 72 being coextensive with pivot 62. Positioning mount 66 includes connect-disconnect plate 60 forming a cutout opening at edge portion 70 at end 74 and further includes a positioning pin 78 connected to upper hinge plate 58. Connect-disconnect plate 60 engages pin 78 when latch 68 locks connect-disconnect plate 60 with upper hinge plate 58.

FIG. 4 illustrates connect-disconnect plate 60 and upper hinge plate 58 in isolation so as to show the quick connect-disconnect features of latch 68. A bolt 80 having end threads is connected to upper hinge plate 58. A cutout 82 formed by connect-disconnect plate 60 along edge portion 70 is adapted to engage bolt 80. Latch 68 has a latch edge 84 rotatably mounted to connect-disconnect plate 60 at pivot 86. Latch 68 forms a cutout 88 as illustrated in FIG. 5 opening at latch edge 84 which is also adapted to receive bolt 80. A lock nut 90 is adapted to be screwed onto bolt 80 when cutouts 76 and 88 are positioned in engagement with bolt 80. Latch 68 is rotatable between a locked position as shown in FIG. 4 and an unlocked position as indicated in phantom line as latch 68A with cutout 88A wherein in the locked position latch 68 engages bolt 80 at cutout 88 and in its unlocked position latch 68 is rotated away from bolt 80 as indicated by latch 68A in phantom.

Strut 48 is rotatably connected at the end of its cylinder 54 to connect-disconnect plate 60 and as shown in FIG. 1 is rotatably connected at the end of arm member 55 to lower hinge plate 40. When lock nut 90 is removed from bolt 80 and latch 68 is rotated to its unlocked position, upper hinge plate 58 can be slid from its engagement with connect-disconnect plate 60 at cutouts 76 and 82 thus freeing cover member 12 from stationary structure 16, or lower housing 16, as the case may be. A second connect-disconnect type hinge analogous to the second hinge system 10 shown in FIG. 3 would connect-disconnect in the same manner. Connecting connect-disconnect plate 60 with upper hinge plate 58 would proceed in the reverse procedure as outlined above.

Figure 7:
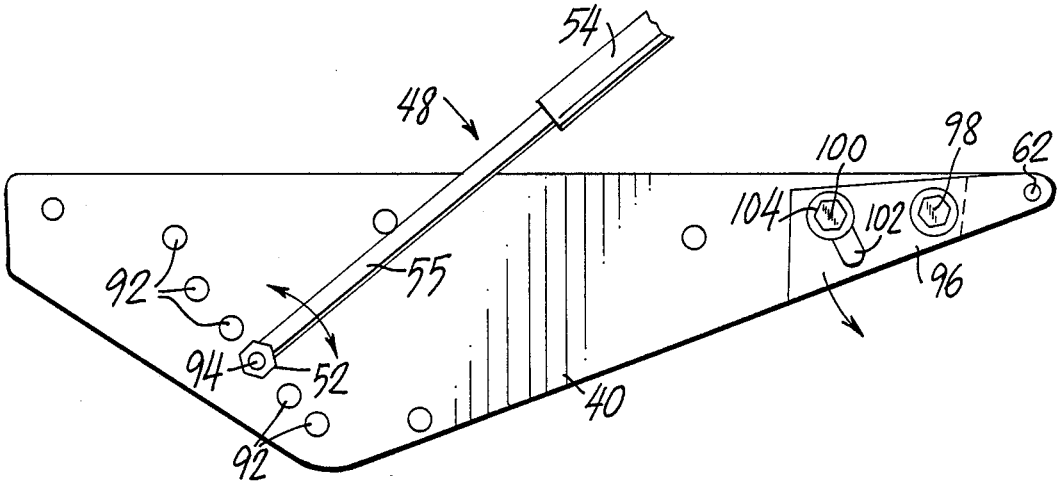
FIG. 7 is an isolated elevational view of the bottom housing hinge plate.

FIG. 7 illustrates lower hinge plate 40 in an isolated view which includes an alternate embodiment of lower hinge plate 40 having six equally spaced pivot holes 92 with end 52 of arm member 55 of pneumatic strut 48 having a pivot 94 removably mounted in a selected one of pivot holes 92. As seen in FIG. 1, pneumatic strut 48 is also pivotably mounted to end 50 to upper hinge plate 36, or, alternatively, as seen in FIG. 2, pivotably mounted to connect-disconnect plate 60 at end 50. When pivot 94 at end 52 moved to a different pivot hole 92, the pressure exerted by pneumatic strut 48 on cover member 12 can be varied in accordance with the selection of a particular pivot hole for arm pivot 94. The variation is pressure exerted is accomplished by the change of angle at which pneumatic strut 48 is pressured against cover member 12 via upper hinge plate 36.

FIG. 7 also illustrates an optional adjusting plate 96 connected to lower hinge plate 40 and to hinge pivot 62 for selectively increasing or decreasing the width of the opening of cover member 12 relative to said container member 16 when cover member 12 is in its open position. A connecting pin 98 rotatably secures adjusting plate 96 to lower hinge plate 40. An adjusting bolt 100 connected to lower hinge plate 40 is spaced distal from hinge pivot 62 relative to connecting pin 98. Adjusting plate 96 has an elongated slot 102 adapted to slidingly receive adjusting bolt 100 in any of a plurality of selected positions, and an adjusting lock nut 104 for adjusting bolt 100 is adapted to lock adjusting plate 96 to lower hinge plate 40 at a selected position of the plurality of selected positions. In this manner the opening of cover member 12 can be increased or decreased relative to container member 16 when cover member 12 is in its open position.

FIGS. 1, 2, and 3 illustrate linear edges 28 and 34 as being generally horizontal and said side walls 24, 26 and 30, 32 as being generally vertical and being associated with a cover member 12 and a container member 16.

Figure 8:
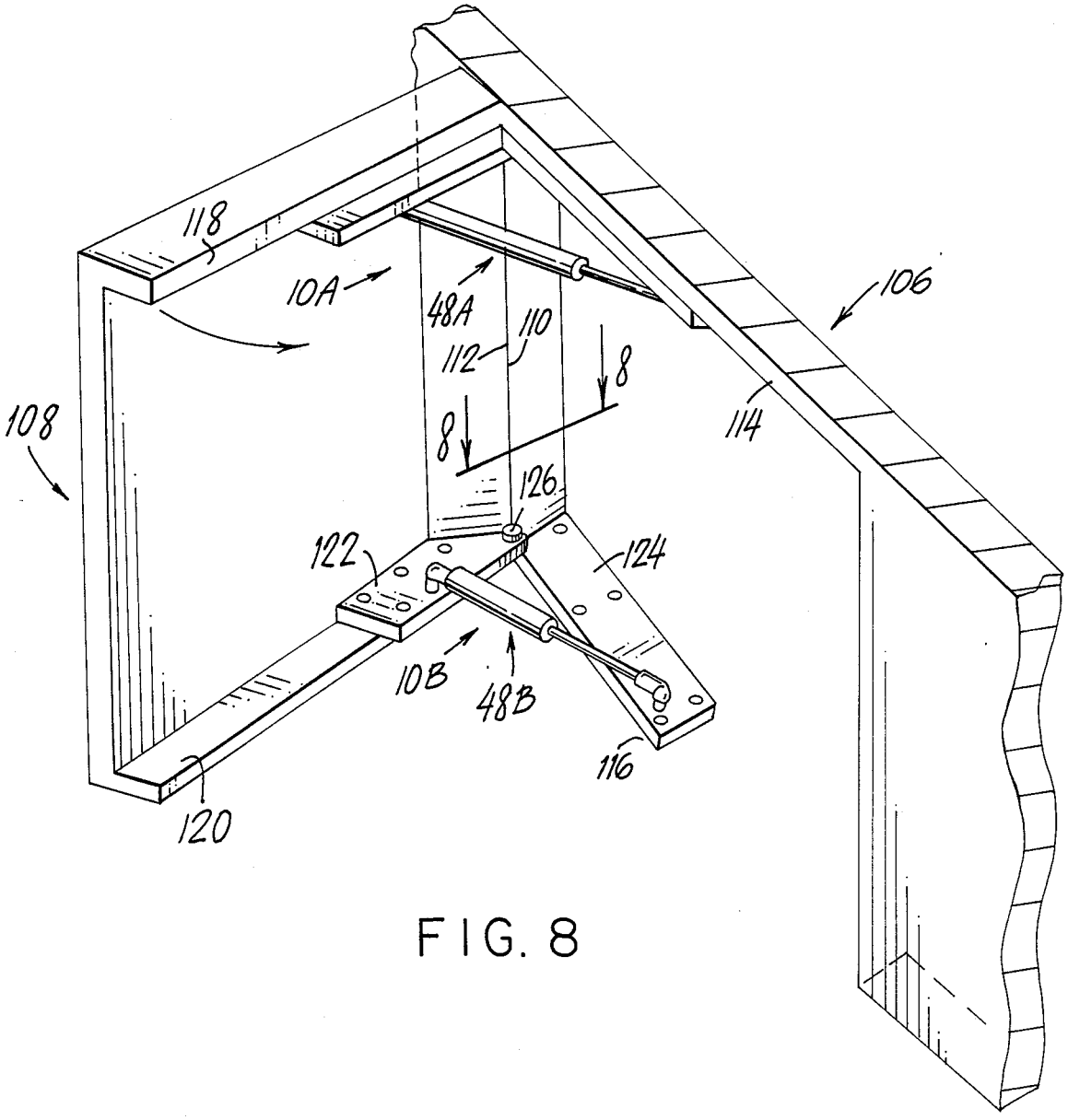
FIG. 8 is a fragmented perspective view of an open door hinged to a base plate.
Figure 9:
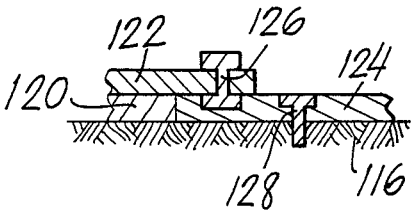
FIG. 9 is a view taken through plane 8—8 of FIG. 7.

FIG. 8 illustrates the inventive hinge system mounted to a doorway 106 and a door 108. The linear edges here are vertical linear edges 110 and 112 along one door jamb 109 of doorway 106 and for the inner vertical edge of door 108; and the side walls being horizontal upper crosspiece 114 and lower threshold 116 for doorway 106 and upper and lower horizontal side walls 118 and 120 extending generally inwardly towards doorway 106 in alignment with crosspiece 114 and threshold 116, respectively. An upper hinge system 10A is mounted to upper crosspiece 114 and upper side wall 118 and a lower hinge system 10B is mounted to threshold 116 and lower side wall 120. Upper and lower pneumatic struts 48A and 48B, respectively, are mounted to upper and lower hinge systems 10A and 10B in the same manner as shown for pneumatic strut 48 in FIG. 1. The alternate embodiments for hinge system 10 as illustrated and described herein as relating to quick connect-disconnect plate 60 in FIGS. 2, 4, and 5; to adjusting pivot holes 92 in FIG. 7; and to adjusting plate 96 in FIG. 7 are also optional for hinge systems 10A and 10B. FIG. 9 illustrates lower door hinge plate 122 connected to door lower side wall 120 and doorway threshold hinge plate 124 hinged to lower hinge pivot 126 with threshold hinge plate 124 secured to threshold 116 by bolt 128.

Pneumatic strut 48 is a gas strut, such as an air strut of the type manufactured by Suspa, Incorporated of Grand Rapids, Mich.

The embodiment of the invention particularly described and disclosed herein is presented merely as an example of the invention. Other embodiments, forms, and modifications of the invention coming within the proper scope and spirit of the appended claims will, of course, readily suggest themselves to those skilled in the art. For example, FIG. 1 can represent a detail of the back of a pickup truck having rear top 130 hinged by hinge system 10 to the rear loading portion 132 with the other elements being analogous to the elements shown in FIG. 1 mutatis mutandis. Likewise, FIG. 2 can represent the back of a pickup truck with a removable rear top 134 hinged to the rear loading portion 136 with the other elements being analogous to the elements shown in FIG. 2 mutatis mutandis.

What is claimed is:

1. In combination, a hinge system hinging a container member to a cover member, comprising: First, hinge means secured to said container member, and second hinge means secured to said cover member and rotatably connected to said first hinge means about hinge pivot means; opening and closing means pivotably mounted to said first and second hinge means for extending said cover member to an open position relative to said container member and for drawing said cover member to a closed position relative to said container member; said container member having at least one first side wall and first linear edge generally perpendicular to said at least one first side wall, and said cover member having a second side wall generally parallel to said at least one first side wall and a second linear edge aligned with a said first linear edge, said first hinge means including at least one first hinge plate connected to said first side wall and said second hinge means includes at least one second hinge plate connected to said second side wall, said cover member being rotatable relative to the container member about said hinge pivot means along said first linear edge, said container member defining an opening, and said cover member being rotatable between said open and closed positions, wherein in said closed position said cover member closes said opening and in said open position said cover member is rotatably spaced from said opening.

2. The combination system according to claim 1, wherein said second hinge means further includes at least one quick connect-disconnect means removably connected to said second hinge plate and rotatably connected to said first hinge plate at said hinge pivot means, said quick connect-disconnect means being for connecting said second hinge plate to said first hinge plate and thus connecting said cover member to said container member and being for disconnecting said second hinge plate to said first hinge plate and thus disconnecting said cover member from said container member.

3. The combination according to claim 2, wherein said opening and closing means is rotatably attached to said quick connect-disconnect means and to said second hinge means.

4. The combination according to claim 3, wherein said quick connect-disconnect means includes a quick connect-disconnect plate positioned adjacent and lateral to said second hinge plate, positioning means associated with said second hinge plate and said quick connect-disconnect plate for removably mounting said quick connect-disconnect plate with said second hinge plate, and latch means associated with said second hinge plate and said quick connect-disconnect plate for removably locking said quick connect-disconnect plate to said second hinge plate.

5. The combination according to claim 4, wherein said connect-disconnect plate includes an edge portion and is generally elongated having opposed first and second ends, said first end being coextensive with said hinge pivot means, and wherein said positioning means includes said connect-disconnect plate forming a third cutout along said edge portion located at said second end and further includes a positioning pin connected to said first hinge plate, said connect-disconnect plate engaging said positioning pin when said latch means is locking said connect-disconnect plate with said first hinge plate.

6. The combination according to claim 4, and wherein said latch means includes a bolt having end threads connected to said first hinge plate, a first cutout formed by said connect-disconnect plate along said edge portion adapted to engage said bolt, a latch having a latch edge facing said bolt and rotatably mounted to said connect-disconnect plate, said latch forming a second cutout along said latch edge adapted to receive said bolt, and a lock nut adapted to be screwed onto said bolt when said first and second cutouts are positioned in engagement with said bolt, said latch being rotatable between locked and unlocked positions wherein in said locked position said latch engages said bolt at said first cutout and in said unlocked position said latch is rotated away from said bolt.

7. The combination according to claim 3, wherein said opening and closing means is at least one pneumatic strut including a pneumatic cylinder and an arm member slidably mounted with said pneumatic cylinder, said pneumatic cylinder being rotatably connected to said first hinge means, and said arm member being rotatably connected to said second hinge means.

8. The combination according to claim 7, wherein said first hinge plate has a plurality of pivot holes and an arm pivot member and said pneumatic strut has opposed ends, one end being at the end of said pneumatic cylinder and the other end being at the end of said arm member, said arm pivot member being connected to said other end, said arm pivot member being adapted to be mounted in a selected one of said plurality of pivot holes, whereby the pressure exerted by said pneumatic strut on said cover member can be varied in accordance with the selection of a particular pivot hole for said arm pivot member.

9. The combination according to claim 2, further including adjusting means connected to said first hinge plate and to said hinge pivot means for selectively increasing or decreasing the width of the opening of said cover member relative to said container member when the cover member is in said open position.

10. The combination according to claim 9, wherein said adjusting means includes an adjusting plate, a connecting pin rotatably securing said adjusting plate to said first hinge plate, and an adjusting bolt connected to said first hinge plate spaced distal from said hinge pivot relative to said connecting pin, said adjusting plate having an elongated slot adapted to slidingly receive said adjusting bolt in any of a plurality of selected positions, and an adjusting lock nut for said adjusting bolt for locking said adjusting plate to said first hinge plate at a selected position of the plurality of selected positions, whereby the width of the opening of said cover member relative to said container member can be increased or decreased when said cover member is in said open position.

11. The combination described in claim 7, wherein said at least one first side wall includes a pair of second side walls, said at least one second side wall includes a pair of second side walls, said at least one first hinge plate includes a pair of first hinge plates, said at least one second hinge plate includes a pair of second hinge plates, and said at least one pneumatic strut includes a pair of pneumatic struts operatively connected to said pair of said first hinge plates and to said pair of second hinge plates.

12. The combination according to claim 1, wherein said first and second linear edges are generally horizontal and said first and second side walls and said another first and second side walls are generally vertical.

13. The combination according to claim 12, wherein said cover member is a lid and said stationary structure is a container.

14. The combination according to claim 13, wherein said lid is the lid of a vibratory sauna and said stationary structure is the lower housing of said vibratory sauna.

15. The combination according to claim 11, wherein said first and second linear edges are generally vertical and said first and second side walls and said another first and second side walls are generally horizontal.

16. The combination according to claim 7 wherein said pneumatic strut is a gas strut.

17. The combination according to claim 16, wherein said gas strut is an air strut.

18. The combination according to claim 2, wherein said opening and closing means is rotatably attached to said first hinge means at a first pivot and to said second hinge means at a second pivot, said first pivot being more distant from said hinge pivot than said second pivot.

19. The combination according to claim 18, wherein said first hinge means includes at least one first hinge plate secured to said container member and said second hinge means includes at least one second hinge plate secured to said cover member and quick connect-disconnect means removably connected to said second hinge plate and rotatably connected to said hinge pivot means, said quick connect-disconnect means being for connecting and disconnecting said at least one first hinge plate from said at least one second hinge plate and thus disconnecting said cover member from said container member, and for connecting said at least one first hinge plate to said at least one second hinge plate and thus connecting said container member to said cover member.

20. The combination according to claim 18, wherein said opening and closing system is at least one pneumatic strut including a pneumatic cylinder and an arm member slidably mounted with said pneumatic cylinder.

* * * * *